US008156677B2

(12) United States Patent
Glock

(10) Patent No.: US 8,156,677 B2
(45) Date of Patent: Apr. 17, 2012

(54) ASSEMBLIES AND FIREARMS INCORPORATING SUCH ASSEMBLIES

(76) Inventor: Gaston Glock, Velden am Woerthersee (AT)

( * ) Notice: Subject to any disclaimer, the term of this patent is extended or adjusted under 35 U.S.C. 154(b) by 224 days.

(21) Appl. No.: 12/761,028

(22) Filed: Apr. 15, 2010

(65) Prior Publication Data

US 2010/0263254 A1 Oct. 21, 2010

(30) Foreign Application Priority Data

Apr. 16, 2009 (AT) ..... A592/2009

(51) Int. Cl.
*F41C 23/10* (2006.01)

(52) U.S. Cl. ..... 42/71.02; 42/71.01

(58) Field of Classification Search ..... 42/71.01, 42/71.02

See application file for complete search history.

(56) References Cited

U.S. PATENT DOCUMENTS

| | | | | |
|---|---|---|---|---|
| 1,005,552 | A * | 10/1911 | Kaldenberg | 42/71.02 |
| 4,286,401 | A * | 9/1981 | Pachmayr et al. | 42/71.02 |
| 4,586,282 | A * | 5/1986 | Sniezak | 42/71.02 |
| D305,923 | S * | 2/1990 | Ferraro et al. | D22/104 |
| 4,936,036 | A * | 6/1990 | Sniezak et al. | 42/71.02 |
| 5,090,147 | A * | 2/1992 | Pastor | 42/70.05 |
| 5,231,237 | A | 7/1993 | Cupp | |
| 6,112,446 | A * | 9/2000 | Forster et al. | 42/71.02 |
| 6,360,470 | B1 | 3/2002 | Constant | |
| 6,430,860 | B1 * | 8/2002 | Constant et al. | 42/84 |
| 6,434,875 | B1 | 8/2002 | Constant | |
| 6,523,296 | B1 * | 2/2003 | Constant et al. | 42/84 |
| 6,560,909 | B2 * | 5/2003 | Cominolli | 42/70.05 |
| 6,571,502 | B1 | 6/2003 | Mikuta | |
| 6,993,864 | B1 * | 2/2006 | O'Clair et al. | 42/75.02 |
| 7,191,556 | B2 | 3/2007 | Pikielny | |
| 7,506,469 | B2 | 3/2009 | Poulin | |
| 7,562,480 | B2 * | 7/2009 | Mauch et al. | 42/70.01 |
| 7,587,852 | B1 * | 9/2009 | Harms | 42/71.02 |
| 7,748,153 | B2 * | 7/2010 | Beretta | 42/71.02 |
| 7,937,874 | B2 * | 5/2011 | Roth | 42/72 |
| 2002/0194762 | A1 * | 12/2002 | Cominolli | 42/70.06 |
| 2006/0096147 | A1 | 5/2006 | Beretta | |
| 2007/0256347 | A1 | 11/2007 | Fitzpatrick | |
| 2008/0060247 | A1 * | 3/2008 | Thomele et al. | 42/71.02 |
| 2009/0071053 | A1 * | 3/2009 | Thomele et al. | 42/1.01 |
| 2009/0282718 | A1 * | 11/2009 | Bartley | 42/75.03 |
| 2010/0071244 | A1 | 3/2010 | Fitzpatrick | |

(Continued)

FOREIGN PATENT DOCUMENTS

| | | |
|---|---|---|
| AT | 399046 | 3/1995 |

(Continued)

OTHER PUBLICATIONS

English Abstract of AT399046.

(Continued)

*Primary Examiner* — Michael Carone
*Assistant Examiner* — Joshua Freeman
(74) *Attorney, Agent, or Firm* — Thomas, Kayden, Horstemeyer and Risley, LLP

(57) ABSTRACT

Assemblies and firearms incorporating such assemblies are provided. In this regard, a representative firearm includes an elongate removable backstrap selectively mountable to a grip of the firearm such that, when mounted thereto, an effective size of the grip is increased. A pin used for mounting the backstrap can also secure a trigger mechanism housing to the receiver of the firearm.

14 Claims, 7 Drawing Sheets

U.S. PATENT DOCUMENTS

| | | | | |
|---|---|---|---|---|
| 2010/0132238 | A1* | 6/2010 | Werner et al. | 42/71.02 |
| 2010/0212202 | A1* | 8/2010 | Roth | 42/71.01 |
| 2011/0219656 | A1* | 9/2011 | McGarry | 42/70.06 |
| 2011/0283581 | A1* | 11/2011 | Freed | 42/49.01 |

FOREIGN PATENT DOCUMENTS

| | | |
|---|---|---|
| DE | 19505829 | 8/1996 |

OTHER PUBLICATIONS

English Abstract of DE19505829.

Publication entitled "Reliability for Life & Liberty" Police M & P Military; Smith & Wesson.

M & P Series Publication; Smith & Wesson 2007; Law Enforcement & Military.

* cited by examiner

ASSEMBLIES AND FIREARMS INCORPORATING SUCH ASSEMBLIES

CROSS REFERENCE TO RELATED APPLICATION

This utility application is a Continuation-In-Part that claims the benefit of and priority to Austrian Patent Application A592/2009, entitled "Griffstück für eine Feuerwaffe", which was filed on Apr. 16, 2009 and which is incorporated by reference herein in its entirety.

BACKGROUND

1. Technical Field

The disclosure generally relates to firearms.

2. Description of the Related Art

The grips for firearms, hereinafter often in brief referred to as "pistols", without the invention being limited to these weapons, serve to provide a solid grip for marksmen and to dampen the impact to the hand and, where applicable, the arm of the marksman when a shot is fired. As different users have different shapes of hands, there is a need to equip weapons with a range of grips. Firearm grips may even be specifically designed for competitive marksmen and special units, and modified for each marksman.

It is common practice for hand weapons, in particular pistols, to have a multipart grip, whereby the individual part can be exchanged for differently shaped and designed parts and/or parts of different sizes, to make the weapon suitable for users with different hand shapes. Such solutions are shown in the Smith & Wesson M&P (Military and Police) brochure (undated) for example, and U.S. 2006/0162222 A, the content of which is incorporated by reference into the present patent application.

While the former method is only viable in specific cases, the second method is both easier and more cost-effective, as it is a type of construction kit that enables users to exchange individual parts of the grip mounted on a basic structure that is also fixed to the frame of the weapon, or is attached to the weapon or follows its contour. This variant also has its drawbacks, however, as a special tool must be used to exchange the individual parts of the handpiece and in compliance with specific conditions of methodical orderliness and safety as, when the interior of the weapon is exposed, screws or other similar loose assembly parts in the weapon may be lost, thus effectively reducing the mechanical stability of the weapon's grip area, as the individual parts of the grip are similar to a housing mounted on a structure, so it is essential that the frame is both stable and solid at the mounting points and at the areas where forces are applied, etc.

SUMMARY

Assemblies and firearms incorporating such assemblies are provided. In this regard, an exemplary embodiment of a firearm comprises: a trigger mechanism housing; a receiver operative to retain the trigger mechanism housing, the receiver having a grip with a rear edge and an outer surface; a removable trigger housing pin operative to mount the trigger mechanism housing to the receiver; and a first attachment configured as a removable backstrap, the first attachment being selectively mountable to the grip such that, when mounted thereto, an effective size of the grip is increased; the first attachment being elongate and having an inner surface, an outer surface, a first end and a second end, the inner surface being oriented to face the outer surface of the grip; the first attachment further having a segment and a first tab, the segment being positioned at the second end and extending from the inner surface, the first tab extending outwardly from a distal end of the segment and toward the first end; the inner surface, the segment and the first tab defining a channel, the channel being sized and shaped to receive the rear edge of the grip to facilitate positioning of the first attachment on the grip.

An exemplary embodiment of an attachment for a firearm having a trigger mechanism housing, a receiver and a removable trigger housing pin, the receiver being operative to retain the trigger mechanism housing and having a grip with a rear edge and an outer surface, the removable trigger housing pin being operative to mount the trigger mechanism housing to the receiver, the attachment comprises: an elongate removable backstrap selectively mountable to the grip such that, when mounted thereto, an effective size of the grip is increased; the backstrap having an inner surface, an outer surface, a first end and a second end, the inner surface being oriented to face the outer surface of the grip; the backstrap further having a segment and a first tab, the segment being positioned at the second end and extending from the inner surface, the first tab extending outwardly from a distal end of the segment and toward the first end; the inner surface, the segment and the first tab defining a channel, the channel being sized and shaped to receive the rear edge of the grip to facilitate positioning of the first attachment on the grip.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Backstrap assemblies and firearms incorporating such assemblies are provided, several exemplary embodiments of which will be described in detail. In this disclosure, the described embodiments pertain to firearms, in particular to handguns, and here specifically to a pistol with a grip, the geometry of which is designed to be adjustable. In this regard, reference is made to the embodiment of FIGS. 1-3, which depict a handgun and specifically a pistol (1), with a grip (2).

Figure 1:
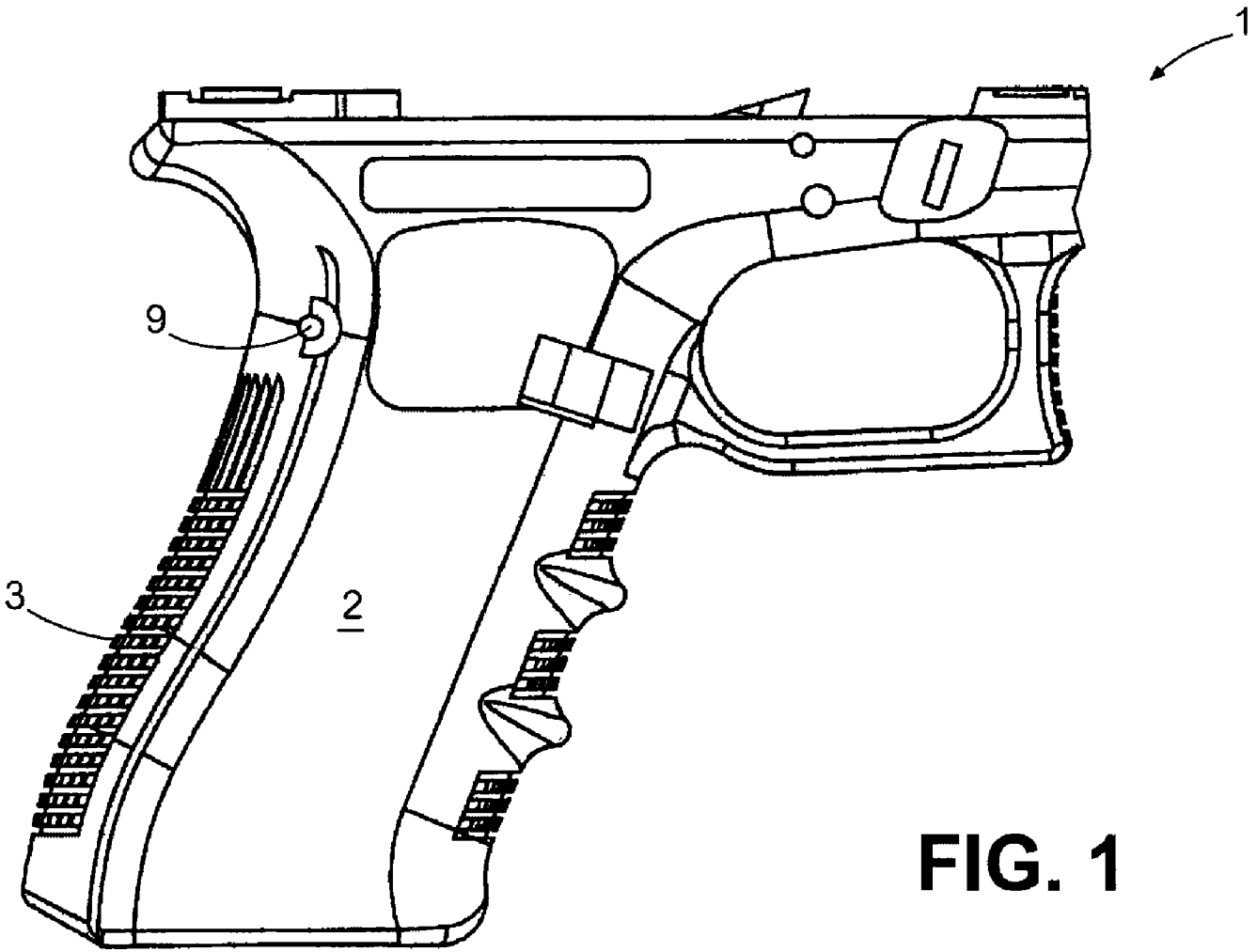
FIG. 1 is a partially cut-away, side view of an embodiment of a firearm without an attachment.
Figure 2:
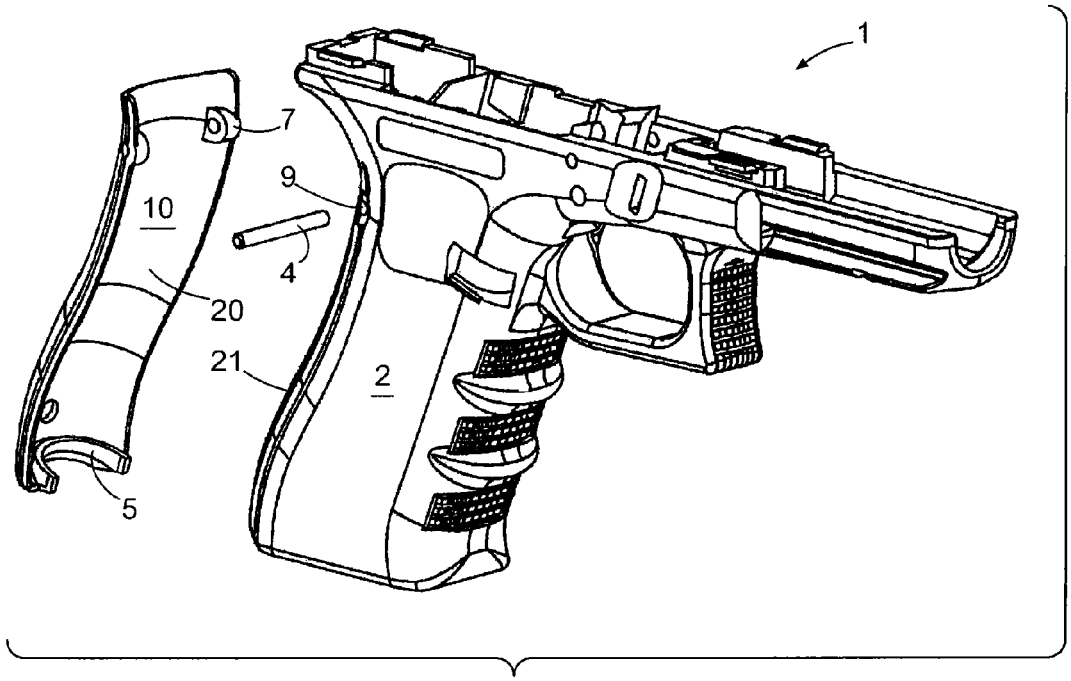
FIG. 2 is a partially exploded, perspective view of the firearm of FIG. 1, showing detail of an embodiment of an attachment and a fixing pin.
Figure 3:
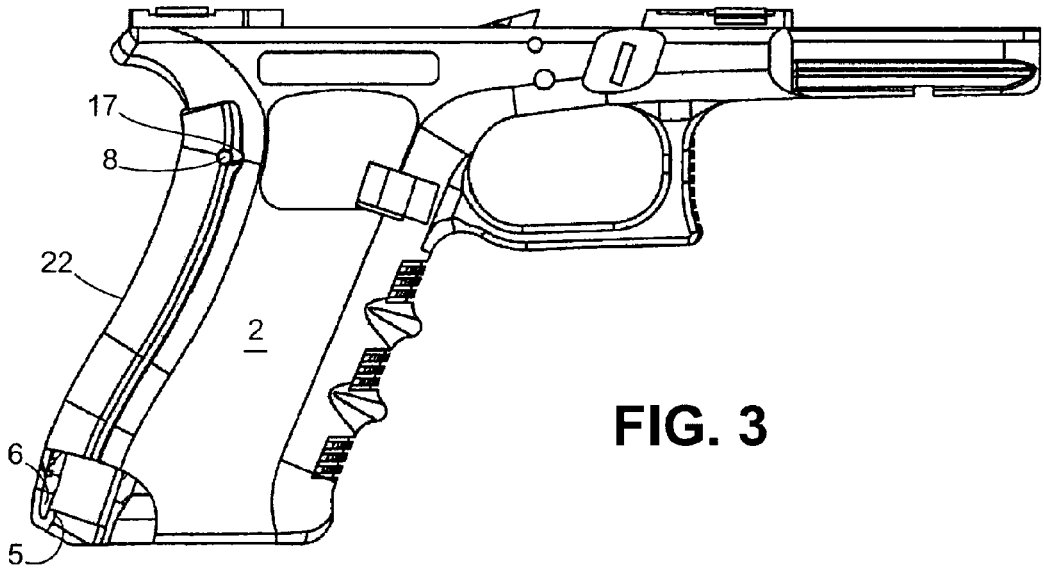
FIG. 3 is a partially cut-away, side view of the firearm of FIGS. 1 and 2, with the attachment and fixing pin mounted.
Figure 4D:
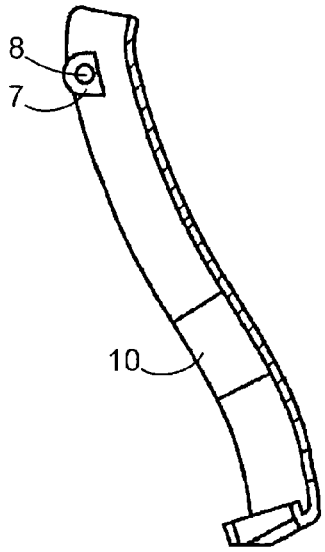
FIGS. 4A-4E show various views of an embodiment of an attachment.
Figure 4A:
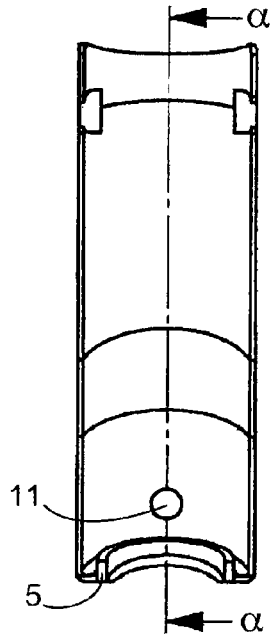
Figure 4E:
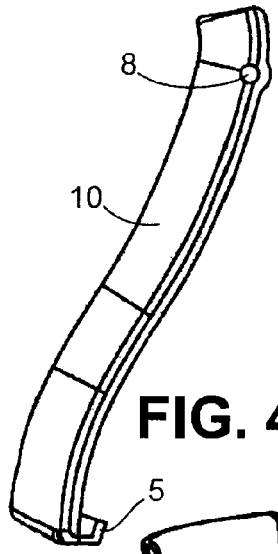
Figure 4C:
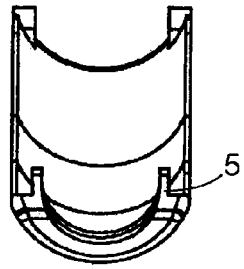
Figure 4B:
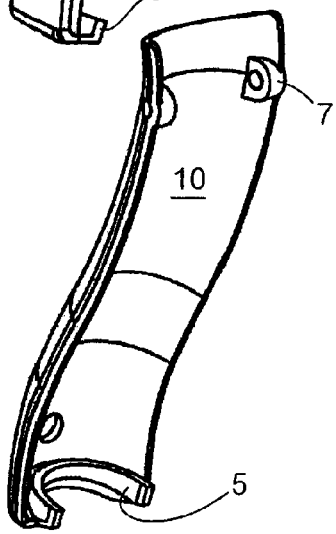

The embodiment of FIGS. 1-3 is characterized such that the grip (2) is standard, i.e. functioning in the same way as a standard grip, but designed to include fastening points (9) on the grip (2) for the optional mounting of an attachment (10) (or "backstrap"), and such that the attachment (10) includes fastening points (5, 7) that would connect and operate with those on the grip.

The embodiment of FIGS. 1-3 aims to avoid various perceived drawbacks and to provide a grip, the shape and/or dimensions of which are adjustable such that the weapon remains serviceable and mechanically stable in any condition and where, as far as possible, the reconfiguration can be carried out without the use of specialized tools, preferably also in the field.

In some embodiments, the grip is designed as a standard, i.e. serviceable, fully enclosed specimen, corresponding to the customary grips. Fastening points may be placed on the grip or on the weapon frame, to which attachments and accessories can be mounted, the contour and dimensions of which may match the contour and dimensions of the corresponding outer surface of the fixed grip to which they are mounted.

Users with larger hands can therefore increase and improve their grip with only a minimum adjustment to the existing weapon, only the fastening points need to be incorporated; the fixed grip therefore represents the smallest possible form of the adjustable grip.

It is preferable to mount the attachment at the back of the weapon facing the grip, as no handling parts or other moving parts are generally located in this area. This is also the place where the grip dimensions can be increased (viewed in the direction of travel) for the modified design to have maximum effect. Moreover, the area on the fixed grip behind the magazine compartment offers the best options for placing the required fastening points.

Furthermore, the fastening points can be recessed in the fixed grip to align with recesses in the mounted attachment, whereby mounting pins are placed in the aligned recesses, each of which will be aligned in a standard plane to the running axle.

It is of course possible to select other fixtures or to combine such assembly pins with other fixtures. Here, hook or claw-shaped protrusions, in particular, could be designed which would then be locked or pushed into the recesses in the fixed grip. It is not essential for the entire surface of the attachment to cover the fixed grip even if this is advantageous for mechanical stability during recoil transfer. Individual points or blocks may be provided to ensure that contact is maintained with the side of the attachment facing the fixed grip, should a lack of contact lead to a local overstrain in certain conditions. In any case, the interior of the supplementary housing need not have an additional design if there is a striated or textured design on the surface of the fixed grip, as locating the attachment at a number of contact points will suffice.

In some embodiments, the user is able to mount several various attachments on the weapon or on the fixed grip as required. Thus, the weapon can be guaranteed to always provide an effective grip, and may continue to be serviceable even when no attachment is mounted.

The pistol in FIG. 1 designated as (1) in its entirety, with only the grip and the accessories mounted directly on it shown, but without the trigger mechanism and trigger pin, etc., has a fully functional grip (2). The working example here shows a striation (3) in the rear area, but this is not an essential element of the invention.

FIG. 2 shows the pistol (1) and its grip (2) in a perspective view with the attachment (10) mounted on the rear of the grip (2), in a linear exploded view. A fixing pin (4) is shown between the pistol (1) and the attachment (10) for fixing the attachment (10) to the grip (2).

As illustrated in FIG. 3, a flange (5) is shown pointing upwards on the lower area of the attachment (10), the rear edge (6) of which protrudes into the interior of the grip (2) when mounted, thus enclosing the rear part of the edge (6). In addition, the attachment (10) shows fastening points (7) with holes (8) included in the working example; this is illustrated particularly well in FIG. 4.

As shown in FIGS. 1 and 2, the pistol (1) has a clearance hole (9) in the upper area of the grip that runs standard to its symmetry plane, the holes (8) of which align when the attachment (10) is mounted. When attached, the fixing pin (4) can be now pushed through the three aligned holes (8, 8 and 9), which will hold the fixing pin in place by frictional locking.

As described above, it is preferable that the shape of the surface area of the attachment (10) facing the grip (2) is designed in such a way that the largest possible surface area or, if the grip (2) has a striated design, is designed to provide as many evenly distributed contact areas over the entire possible covering area commensurate with smaller sizes. The forces generated when firing will therefore be transferred evenly from the grip to the attachment and to the user's hand.

It is particularly advantageous that, when mounted, the area (20) of the attachment (10) facing the grip matches the geometry of the opposite surface area (21) of the grip (2) to ensure that the contact area of the attachment constitutes over 30%, and preferably over 50%, of the surface area when the "exposed" area of the grip between the contour of the mounted attachment and the surface of the grip has no striations, etc.

As can be seem from the synopsis of FIGS. 1 and 2, the grip (2) is designed to sit next to the clearance hole (9) such that it fixes the dedicated fastening points (7) of the attachment (10), i.e. such that the grip is geometrically accurate, so that when the attachment (10) is mounted, it runs in the direction of the principal axis of the grip (2) and presses in the direction of travel. Thus, a geometrically defined final position is achieved whereby the clearance hole (9) and the holes (8) are aligned. This should facilitate assembly and, in particular, should ensure that the contact area with the fixing pin (4) achieves a geometrically accurate and therefore also mechanically stable fit.

In the example shown in FIGS. 2-4E, the attachment (10) has no striation on its outer side (22), and the attachment (10) can also be supplied with such or a differently designed striation.

It is conceivable that, when selecting another material thickness for the attachment (10), not only could the size be adjusted within certain limits, but also the shape of the entire grip (the grip (2)+the attachment (10)) to suit the personal requirements or preferences of the weapon user. In addition, as seen in the section view (4D, as cut along section line a-a in FIG. 4A), users could also choose a different thickness to the one shown.

The embodiment of FIGS. 4A-4E show an additional opening (11) in the attachment (10) to prevent the attachment from "sticking" to the grip (2), particularly if the grip is smooth, and also to facilitate the dismantling of the attachment after removing the fixing pin (4) from the clearance hole (9) and the holes (8), e.g. using a mounting-demounting pin, as is common practice in various weapons using current technology.

Plastic is the most suitable material to use for the attachment (10) as, owing to the easy and geometrically accurate properties of manufacture, reinforcing elements could be added to the interior of the part, particularly around the fastening points (7) as would be readily understood to one of ordinary skill.

The fastening points (7) could be designed differently or located at different points to those shown; the flange could be a different shape or could be replaced by an additional set of fastening points; all of which lie within the scope of the invention. It should be noted here that functionally in the exemplary embodiment shown in FIGS. 1-4E, the edge (6) of the grip (2) and the surrounding area (17) of the clearance hole (9) are to be considered fastening points which shows their alternative design options.

Figure 5:
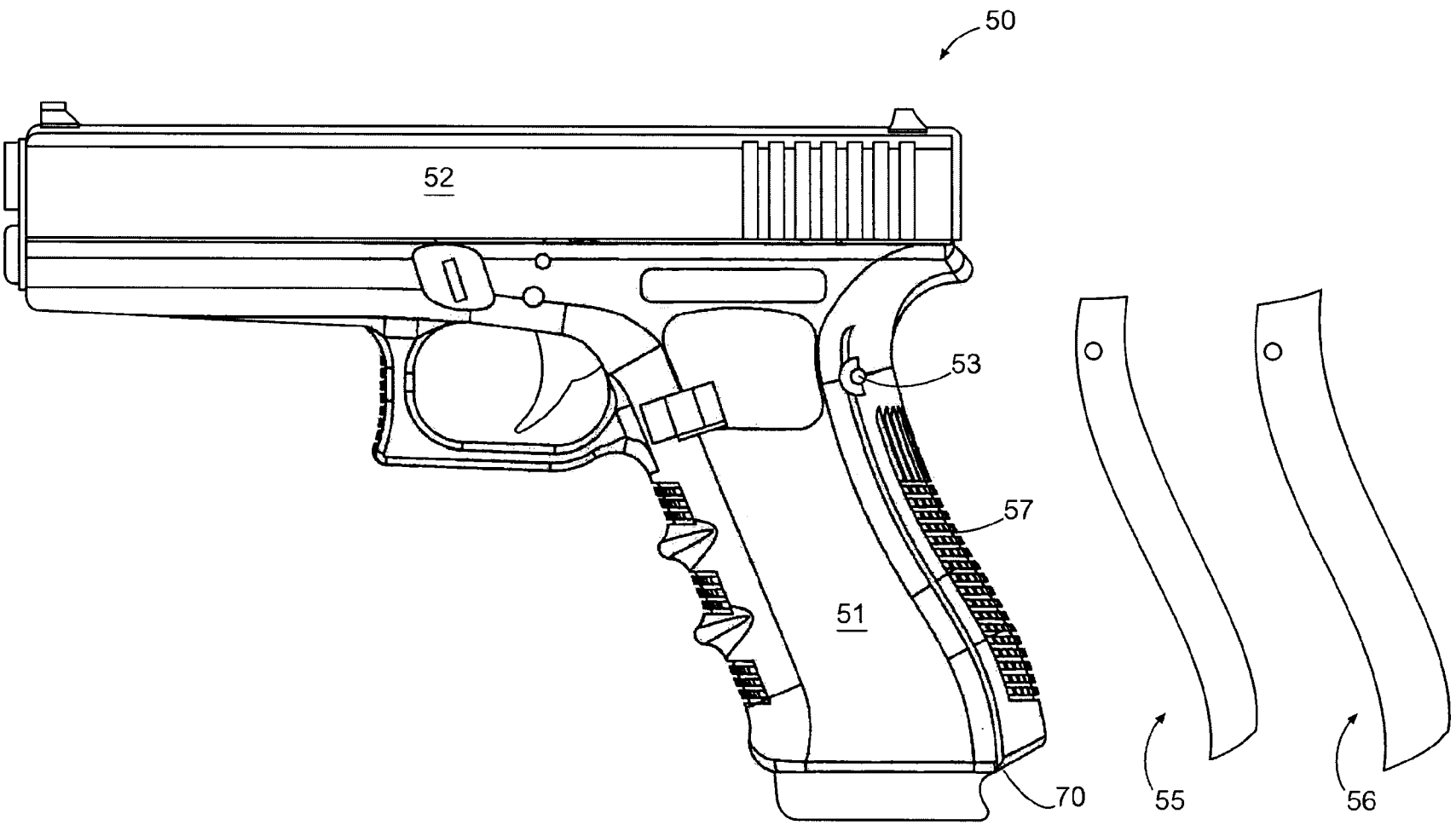
FIG. 5 is a side view of an embodiment of a firearm with multiple attachments.

FIG. 5 is a side view of another embodiment of a firearm shown with multiple attachments. As shown in FIG. 5, firearm (50) is configured as a pistol with a grip (51) extending generally downwardly relative to a slide (52). The grip is sized and shaped to accommodate users with hands of a first size, and is further configured to mount an attachment at a rear, outer surface (57). For mounting of an attachment, a pin (53) is used.

In FIG. 5, note that the pin (53) is installed in the firearm and functions as a trigger housing pin that retains a position of a corresponding trigger mechanism housing (54). When an attachment is mounted to the firearm, the pin serves the additional function of forming a friction fit to retain the position of the attachment until the pin is removed.

In this embodiment, two attachments (55, 56) are shown. Specifically, attachment (55) is sized and shaped to enlarge the effective size of the grip, thereby accommodating users with hands of a second size larger than the first. Attachment (56) is sized and shaped to enlarge the effective size of the grip, thereby accommodating users with hands of a third size larger than the second. It should be noted that, in other embodiments, various other numbers of attachments can be provided.

Figure 6:
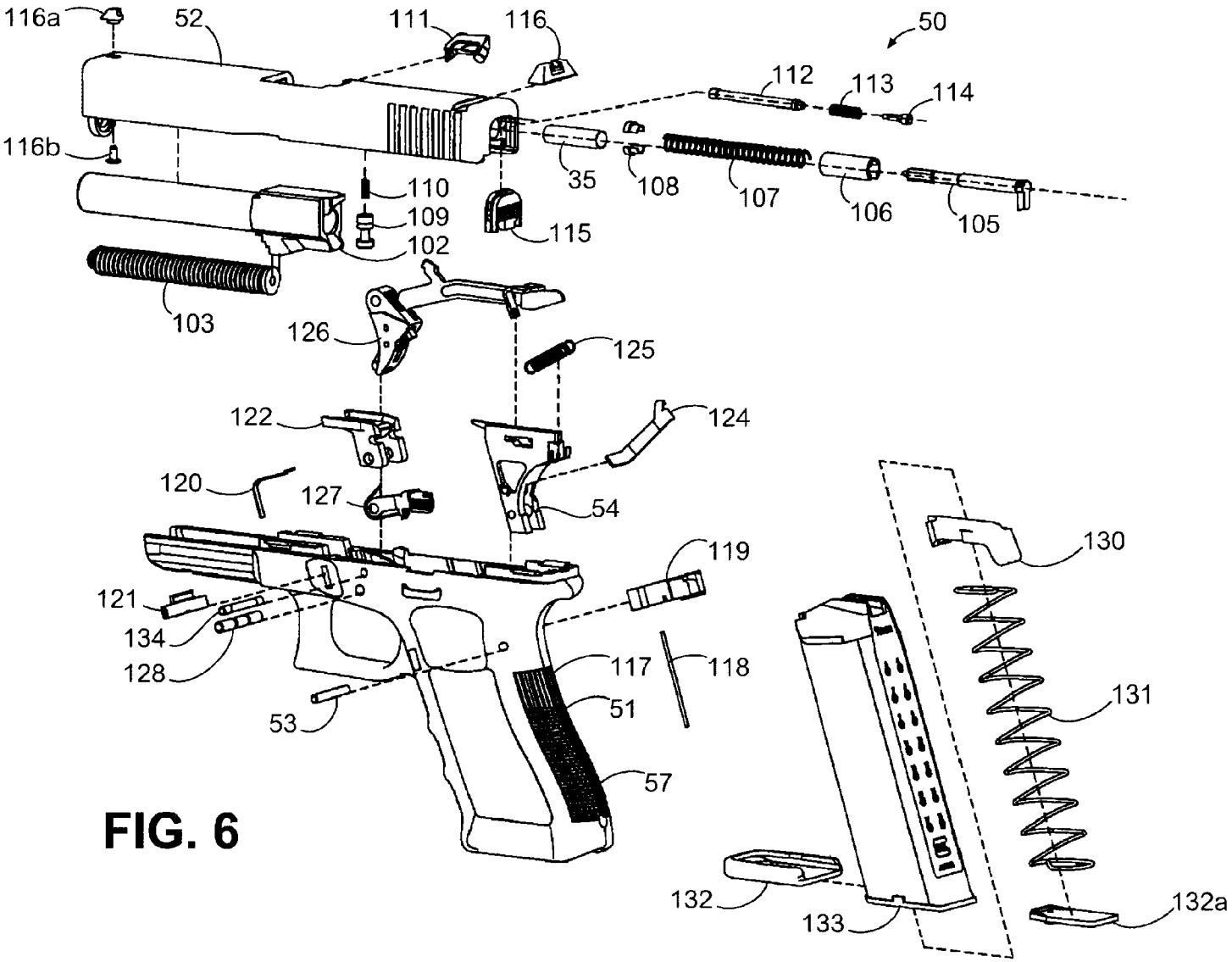
FIG. 6 is an exploded view showing the embodiment of FIG. 5 in greater detail.

FIG. 6 is an exploded view that shows the embodiment of firearm 50 in greater detail. As should be known to one of ordinary skill, various firearms can include different components. However, the following components are mentioned as representative examples. In this regard, firearm 50 incorporates slide (52), barrel (102), recoil spring assembly (103), firing pin (105), spacer sleeve (106), firing pin spring (107), spring cups (108), firing pin safety (109), and firing pin safety spring (110). Additionally, firearm (50) includes extractor (111), extractor depressor plunger (112), extractor depressor plunger spring (113), spring-loaded bearing (114), slide cover plate (115), rear sight (116), front sight and screw (116*a* and 116*b*), and receiver 117. Also included are magazine catch spring (118), magazine catch (119), slide lock spring (120), slide lock (121), locking block (122), trigger mechanism housing with ejector (54), connector (124), trigger spring (125), trigger with trigger bar (126), slide stop lever (127), trigger pin (128), trigger housing pin (53), follower (130), locking block pin 134 and channel liner (135). The firearm (50) typically operates with a magazine that includes spring (131), floor plate (132), insert (132*a*), and tube (133).

Figure 7A:
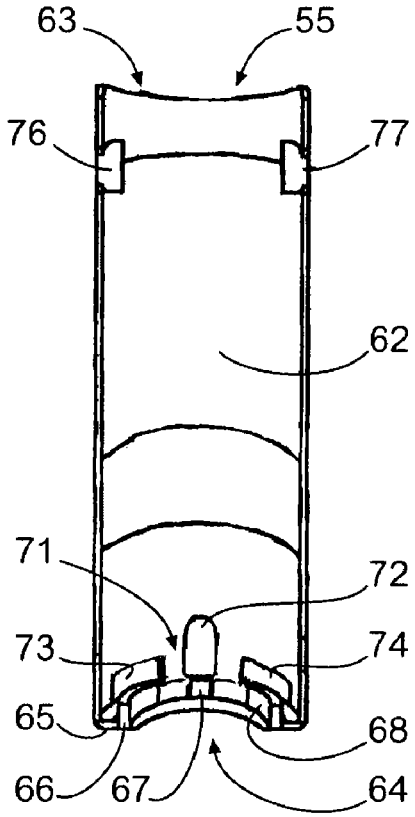
FIGS. 7A-7C show various views of another embodiment of an attachment.
Figure 7B:
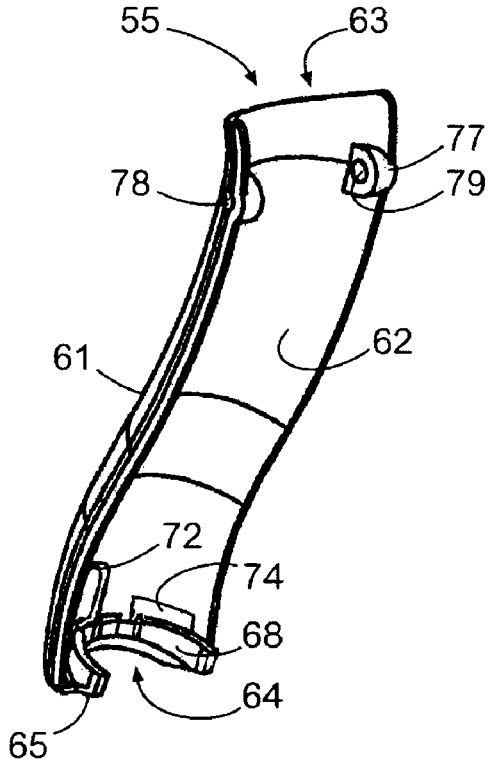
Figure 7C:
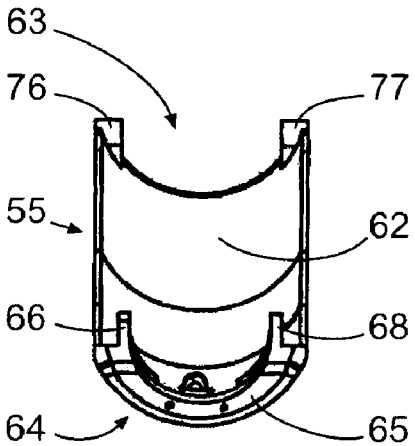

FIGS. 7A-7C show various views of attachment (55). In a general sense, attachment (55), which is configured as a removable backstrap, is elongate component exhibiting a longitudinal axis. The longitudinal axis functions generally as a line of symmetry for the attachment, although various asymmetric concessions can be expressed to enhance ergonomics in some embodiments.

Attachment (55) incorporates an outer surface (61), an inner surface (62), a first end (63) and a second end (64). An annular segment (65) protrudes outwardly from the inner surface at the second end and functions as a flange. Tabs (66, 67 and 68) are spaced along a distal end of the annular segment, with each extending toward the first end. The annular segment and corresponding tabs are oriented to engage a rear edge (70) of the grip such that the rear edge seats within the channel (71) defined by the inner surface, the annular segment and the tabs when the attachment is mounted to the grip.

A lanyard aperture (72) is oriented along the longitudinal axis of the attachment (55) to align with a corresponding aperture (not shown) of the grip. Additionally, release apertures (73, 74) configured as rectangular slots are located at the second end and flank the lanyard aperture. The release apertures assist in removing the attachment from the grip.

Fastening points (76, 77) oriented toward the first end define holes (78, 79) for receiving the pin (53).

Figure 8A:
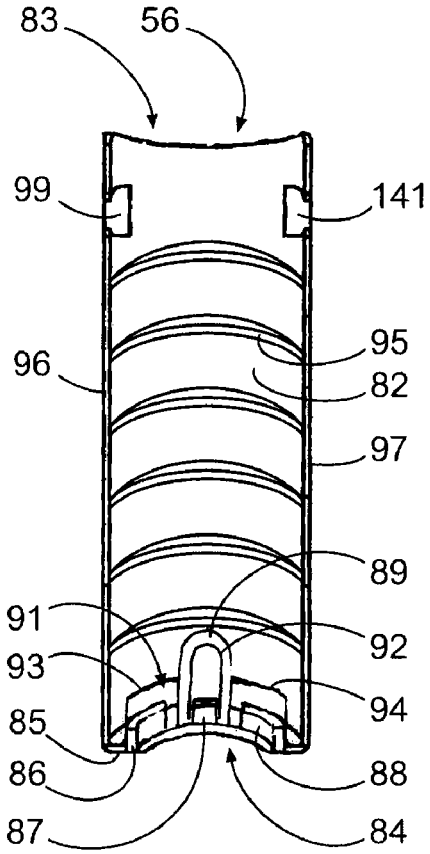
FIG. 8A-8C show various views of another embodiment of an attachment.
Figure 8B:
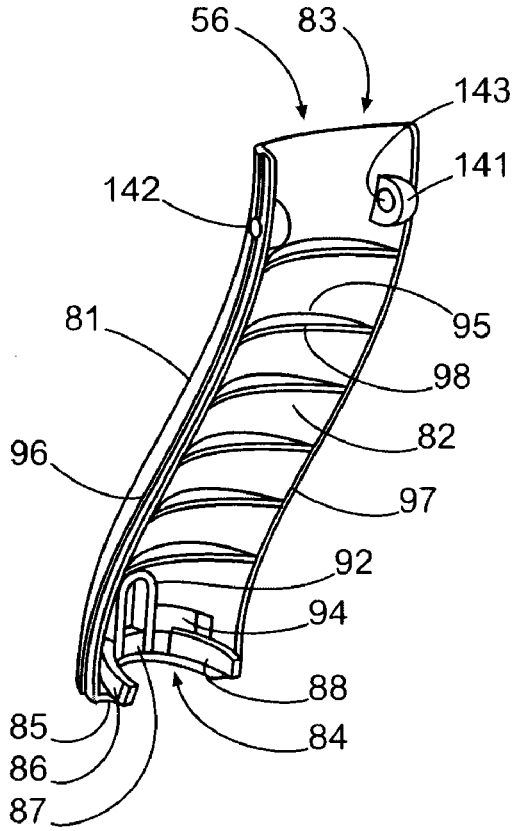
Figure 8C:
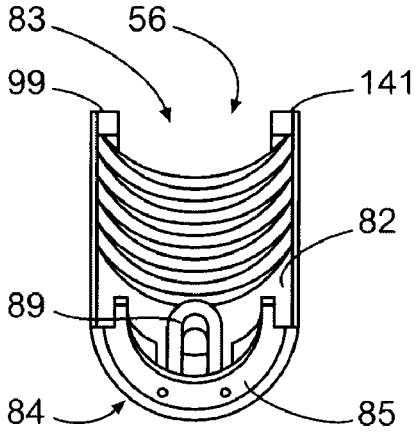

FIGS. 8A-8C show various views of attachment (56). Attachment (56) is configured as a removable backstrap for enlarging the grip to an extent greater than that accomplished by attachment (55).

Attachment (56) incorporates an outer surface (81), an inner surface (82), a first end (83) and a second end (84). An annular segment (85) protrudes outwardly from the inner surface at the second end and functions as a flange. Tabs (86, 87 and 88) are spaced along a distal end of the annular segment, with each extending toward the first end. Additionally, a protrusion (89) extends from the inner surface. As such, the annular segment, the protrusion and corresponding tabs are oriented to engage a rear edge (70) of the grip such that the rear edge seats within the channel (91) defined by the protrusion, the annular segment and the tabs when the attachment is mounted to the grip.

A lanyard aperture (92) is oriented along the longitudinal axis of the attachment (56) to align with a corresponding aperture (not shown) of the grip. In this embodiment, the protrusion (89) is coextensive with a portion of the lanyard aperture. Additionally, release apertures (93, 94) configured as rectangular slots are located at the second end and flank the lanyard aperture. The release apertures assist in removing the attachment from the grip.

It should be noted that in order to increase the grip size, attachment (56) exhibits a greater depth than that of attachment (55). As such, the radial extent of annular segment (85) is greater than that of annular segment (65). Additionally, attachment (56) incorporates ribs (e.g., rib (95)) that protrude outwardly from the inner surface and generally extend between the opposing side edges (96, 97). In this embodiment, the distal ends (e.g., end (98)) of the ribs are shaped to engage corresponding portions of the rear surface of the grip for at least one of supporting the structure of the attachment, assisting in alignment of the attachment and/or distributing forces among the user, attachment and grip.

Fastening points (99, 141) oriented toward the first end define holes (142, 143) for receiving the pin (53).

An exemplary embodiment of a firearm, in particular a handgun and specifically a pistol, with a grip such that the grip is designed as a normal grip, i.e. serviceable and corresponding to normal grips, for which fastening points have been included on the grip for the optional mounting of an attachment, such that the attachment includes fastening points that operate with those on the grip.

In some embodiments, a minimum of one fastening point on the grip includes at least one clearance hole and at least one dedicated fastening point on the attachment and holes, such that the holes and the clearance hole are aligned when the attachment is mounted, and such that a fixing pin is located in the holes and the clearance hole, preferably held in place by friction locking.

Some embodiments incorporate a fastening point on an area on the lower edge of the grip, and a dedicated fastening point on the attachment from a flange that encloses the edge of the attachment when mounted.

An exemplary embodiment of an attachment to be mounted on a firearm, in particular a pistol includes fastening points for mounting attachments on the grip of the firearm.

In some embodiments, the area of the attachment facing the grip and the area of the grip itself are geometrically designed such that the contact area constitutes over 30%, and preferably over 50% of the surface area when the attachment is mounted.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. A firearm comprising:

a trigger mechanism housing;

a receiver operative to retain the trigger mechanism housing, the receiver having a grip with a rear edge and an outer surface;

a removable trigger housing pin operative to mount the trigger mechanism housing to the receiver; and a first attachment configured as a removable backstrap, the first attachment being selectively mountable to the grip such that, when mounted thereto, an effective size of the grip is increased;

the first attachment being elongate and having an inner surface, an outer surface, a first end and a second end, the inner surface being oriented to face the outer surface of the grip;

the first attachment further having a segment and a first tab, the segment being positioned at the second end and extending from the inner surface, the first tab extending outwardly from a distal end of the segment and toward the first end;

the inner surface, the segment and the first tab defining a channel, the channel being sized and shaped to receive the rear edge of the grip to facilitate positioning of the first attachment on the grip.

2. The firearm of claim 1, wherein:

the receiver has a first hole and a second hole; and the first attachment further comprises a first mounting hole and a second mounting hole operative to receive the trigger housing pin such that, when the first attachment is mounted to the grip, the trigger housing pin extends through the first mounting hole, through the first hole of the receiver, through the trigger mechanism housing, through the second hole of the receiver, and then through the second mounting hole.

3. The firearm of claim 1, wherein the trigger housing pin forms a friction fit with the first attachment.

4. The firearm of claim 1, wherein the segment is an annular segment.

5. The firearm of claim 1, wherein:

the first attachment has a second tab and a third tab, each of which extends from the segment;

the first tab, the second tab and the third tab assist in defining the channel.

6. The firearm of claim 1, wherein the first attachment further comprises a release aperture position at the second end.

7. The firearm of claim 1, further comprising a second attachment configured as a removable backstrap, the second attachment being selectively mountable to the grip such that, when mounted thereto, an effective size of the grip is increased relative to the effective size of the grip when the first attachment is mounted thereto;

the second attachment being elongate and having an inner surface and a first rib, the first rib extending outwardly from the inner surface of the second attachment and having a distal end configured to conform to a corresponding portion of the outer surface of the grip.

8. The firearm of claim 7, wherein the second attachment has a rib extending outwardly from the inner surface thereof, the rib having a distal end configured to conform to a corresponding portion of the outer surface of the grip.

9. The firearm of claim 1 configured as a pistol.

10. An attachment for a firearm having a trigger mechanism housing, a receiver and a removable trigger housing pin, the receiver being operative to retain the trigger mechanism housing and having a grip with a rear edge and an outer surface, the removable trigger housing pin being operative to mount the trigger mechanism housing to the receiver, the attachment comprising:

an elongate removable backstrap selectively mountable to the grip such that, when mounted thereto, an effective size of the grip is increased;

the backstrap having an inner surface, an outer surface, a first end and a second end, the inner surface being oriented to face the outer surface of the grip;

the backstrap further having a segment and a first tab, the segment being positioned at the second end and extending from the inner surface, the first tab extending outwardly from a distal end of the segment and toward the first end;

the inner surface, the segment and the first tab defining a channel, the channel being sized and shaped to receive the rear edge of the grip to facilitate positioning of the first attachment on the grip.

11. The attachment of claim 10, wherein:

the backstrap has a second tab and a third tab, each of which extends from the segment;

the first tab, the second tab and the third tab assist in defining the channel.

12. The attachment of claim 10, wherein the backstrap further comprises a release aperture position at the second end.

13. The attachment of claim 10, wherein the backstrap has a rib extending outwardly from the inner surface thereof, the rib having a distal end configured to conform to a corresponding portion of the outer surface of the grip.

14. The attachment of claim 10, wherein the backstrap further comprises a first mounting hole and a second mounting hole operative to receive the trigger housing pin.

* * * * *